United States Patent [19]

Billeter

[11] Patent Number: 4,671,205

[45] Date of Patent: Jun. 9, 1987

[54] APPARATUS FOR APPLYING PARTIAL SURFACE COATINGS

[75] Inventor: Armin Billeter, Grüt, Switzerland

[73] Assignee: Billeter Kunstsoffpulver A.G., Zurich, Switzerland

[21] Appl. No.: 476,873

[22] PCT Filed: Jul. 16, 1982

[86] PCT No.: PCT/CH82/00089

§ 371 Date: Mar. 14, 1983

§ 102(e) Date: Mar. 14, 1983

[87] PCT Pub. No.: WO83/00348

PCT Pub. Date: Feb. 3, 1983

[30] Foreign Application Priority Data

Jul. 21, 1981 [CH] Switzerland ..... 4767/81
Feb. 19, 1982 [CH] Switzerland ..... 1052/82

[51] Int. Cl.[4] ..... B05C 3/18; B05C 3/20

[52] U.S. Cl. ..... 118/68; 118/302; 118/323; 118/325; 118/406; 118/410; 118/415; 118/641

[58] Field of Search ..... 118/302, 323, 301, 406, 118/308, 325, 415, 63, 641, 68, 410; 101/120, 366; 427/286, 288, 208.2, 348

[56] References Cited

U.S. PATENT DOCUMENTS

| | | | |
|---|---|---|---|
| 537,923 | 4/1895 | Hildyard | 118/301 X |
| 2,111,761 | 3/1938 | Eckert | 118/302 X |
| 2,333,382 | 11/1943 | Kent | 118/406 X |
| 3,106,481 | 10/1963 | Sorg | 427/208.2 |
| 3,577,915 | 5/1971 | Thompson et al. | 427/288 X |
| 3,768,280 | 10/1973 | Kannegiesser et al. | 118/641 X |
| 4,023,487 | 5/1977 | Mitter | 101/120 |

*Primary Examiner*—Evan K. Lawrence
*Attorney, Agent, or Firm*—Helfgott & Karas

[57] ABSTRACT

Apparatus for applying partial surface coatings to textile substrates, particularly adhesive compounds in fixing inset technology. A cylinder rotatable about a cylindrical axis has inner and outer cylindrical surfaces with perforations extending through these surfaces. A coating head mounted inside the cylinder has a coating nozzle adjacent and facing the inner surface. The head includes a feed duct, a main duct extending from the feed duct and an opening chamber extending from the main duct. The opening chamber is bounded by two sealing lips adapted closely to the inside of the cylinder, supported by a mounting structure for the chamber and defining an outlet opening therebetween for controlling flow from the chamber. The structure has rods attached to the lips and adjustably coupled to the coating head to enable the opening to be adjusted in width.

17 Claims, 10 Drawing Figures

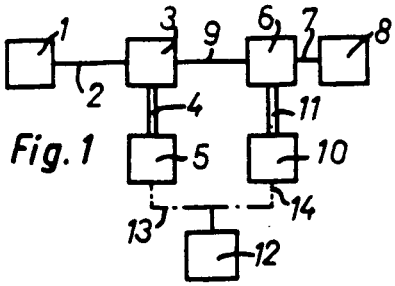
Fig. 1
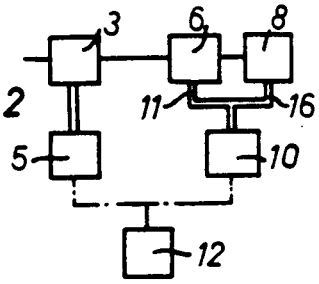
Fig. 2
Fig. 3
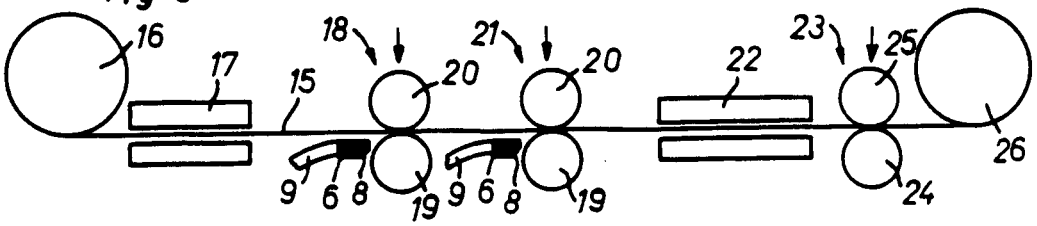
Fig. 4
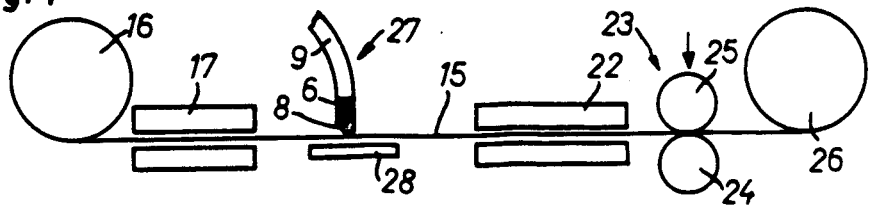
Fig. 5
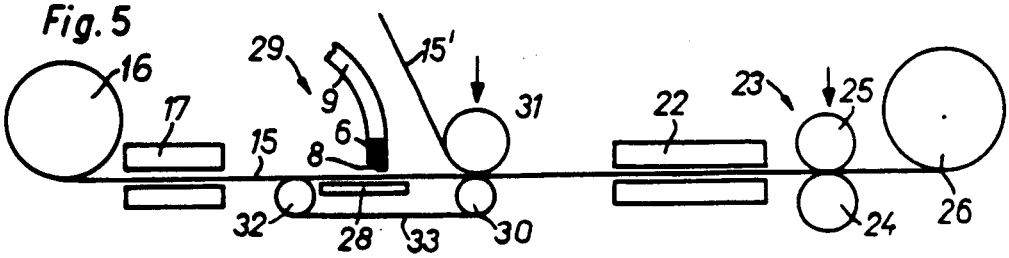
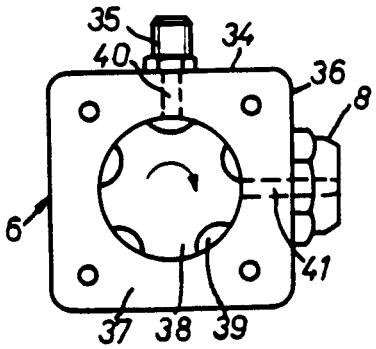
Fig. 6

APPARATUS FOR APPLYING PARTIAL SURFACE COATINGS

FIELD OF THE INVENTION

The invention relates to an apparatus for applying partial surface coatings to textile substrates, particularly adhesive materials in insert fixing technology in which a flowable thermoplastic or thermosetting plastic coating compound is applied to the substrate and is made to firmly adhere thereto.

BACKGROUND OF THE INVENTION

Numerous processes are known for the coating of textile substrates, e.g. non-woven fabrics, fabrics and gauze materials. Most of the coating compounds are adhesive compounds, which are applied for the firm joining of a substrate to the coated substrate in the adhesive state or are made adhesive after application, the adhesive compound being brought into a stable state after adhesion has taken place. High demands are made on such joints in the textile industry with respect to the binding strength, the durability, lack of sensitivity to external influences and elasticity and these are fulfilled to a varying extent by the known processes, as will be shown hereinafter.

The known foil coating in which a separately produced foil of thermoplastic material is pressed onto a preheated textile substrate or an extruded foil is applied in the still warm state to the substrate and is pressed onto the latter, as well as surface coating in which a thermoplastic powder mixed to form a paste is scraped onto a textile web, dried, heated and adhered to the substrate in the slightly liquid state by roller pressure are only used to a limited extent in the textile field, because continuous, uninterrupted thermoplastic coatings during the subsequent adhesion to other textile substrates through temperature, time and pressure have excessive thermal and washing shrinkage values particularly for the clothing industry and also give the end product a non-textile feel.

In the known sprinkling or dusting process, a thermoplastic coating material preground or screened out to a particular particle size distribution is sprinkled onto a preheated textile web, further heated in an oven and then firmly adhered to the textile substrate in the slightly liquid state by roller pressure. As such coatings are irregular, substrates coated in this way after adhering to other thin, smooth upper-materials conventionally used especially in the shirt and blouse industry lead to an orange skin-like surface of the article of clothing following a cleaning treatment.

In the net coating process, an extruded net or a longitudinally slotted foil is spread out and adhered to the preheated textile web. When the stretched net is heated, the connection points tear and the now projecting extensions draw back again into the intersections of the net, so that a non-continuous, punctiform coating of excellent regularity is obtained, but this process is little used because it is uneconomic.

The regular partial, e.g. punctiform coating of the substrate with an adhesive material represents an essential requirement of the clothing industry, obviously whilst respecting the aforementioned requirements. Various processes are known for this. Rotary screen process printing is very widely used in which thermoplastic powder mixed to form a paste by means of binders is applied by a doctor blade with the desired opening pattern to the substrate through the openings of a cylinder screen printing block moving along the substrate. After drying the binder, the thermoplastic material is partly melted and joined to the substrate by roller pressure. This process is also known in conjunction with the use of a ground thermoplastic adhesive material, but the same uniformity as obtained in the processing of pastes is not achieved. The end product is in fact similar to that obtained with the sprinkling or dusting process and has the same disadvantages.

The known intaglio printing-based processes are very economic. Such processes have proved advantageous in connection with the use of a thermoplastic powder, which is scraped onto a roller having depressions arranged in the desired way. A preheated textile web receives the powder, which is further heated in a continuous heating furnace and then firmly adhere to the substrate by roller pressure.

All the known processes function with thermoplastic materials ground and/or screened to particular particle sizes, which is expensive.

SUMMARY OF THE INVENTION

The object of the present invention is to provide an apparatus for practicing; a process of the aforementioned type so that the coating compounds can be applied from materials in their original and generally granular form, i.e. do not have to be ground and/or screened, whilst still permitting a perfect partial surface coating of the substrate, without having to accept limitations with regards to the arrangement and form of the coating.

In accordance with one embodiment of the invention this object is achieved by an apparatus for applying partial surface coatings to textile substrates, particularly adhesive compounds, which employs a rotatable metal cylinder having inner and outer cylindrical surfaces having perforations extending therethrough from said inner surface to said outer surface and being rotatable about a longitudinal axis. A coating head is mounted inside the cylinder and has at least one coating nozzle adjacent and facing the inner surface. The coating head is a beam extending parallel to said axis and includes a feed duct, a main duct extending from the feed duct and an opening chamber extending from the main duct. The opening chamber is bounded by two sealing lips adapted closely to the inside of the cylinder, supported by mounting means on the coating head and defining an outlet opening therebetween for the controlling flow from opening chamber.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 1 is a schematic, block diagram of a system for applying thermoplastic and thermosetting plastic compounds to textile substrates according to a first embodiment of the present invention;

FIG. 2 is a schematic, block diagram of a system for applying thermoplastic and thermosetting plastic compounds to textile substrates according to a second embodiment of the present invention;

FIG. 3 is a diagrammatic, side elevational view of an apparatus for applying coating compounds according to a first embodiment of the present invention;

FIG. 4 is a diagrammatic, side elevational view of an apparatus for applying coating compounds according to a second embodiment of the present invention;

FIG. 5 is a diagrammatic, side elevational view of an apparatus for applying coating compounds according to a third embodiment of the present invention;

FIG. 6 is an end elevational view of a coating head according to the present invention;

DETAILED DESCRIPTION OF THE PREFERRED EMBODIMENTS

Figures 7, 8:
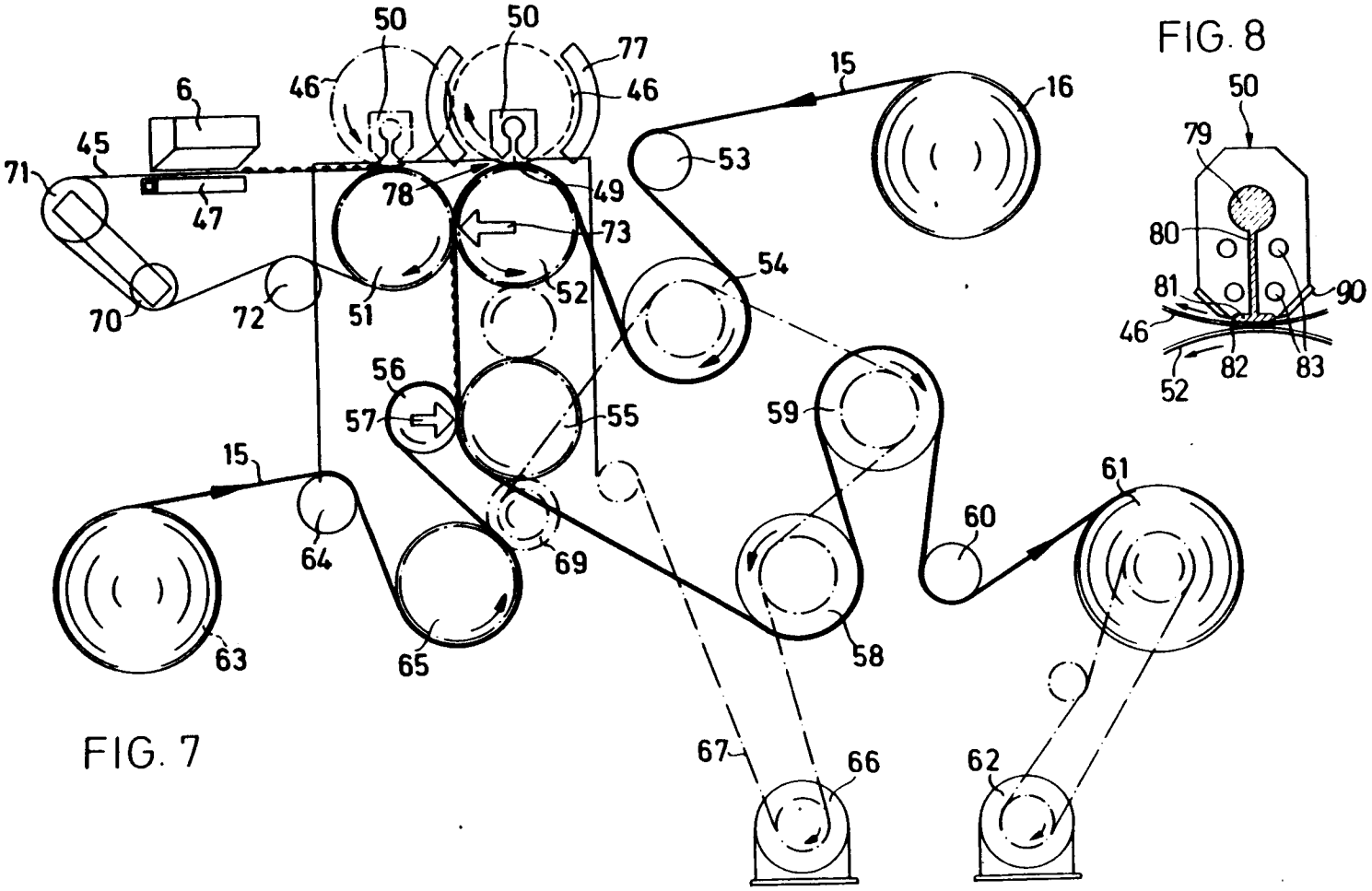
FIG. 7 is a diagrammatic, side elevational view of an apparatus for applying coating compounds to textile substrates according to a fourth embodiment of the present invention.
FIG. 8 is a partial, enlarged, elevational view of the coating head of FIG. 7.
Figure 9:
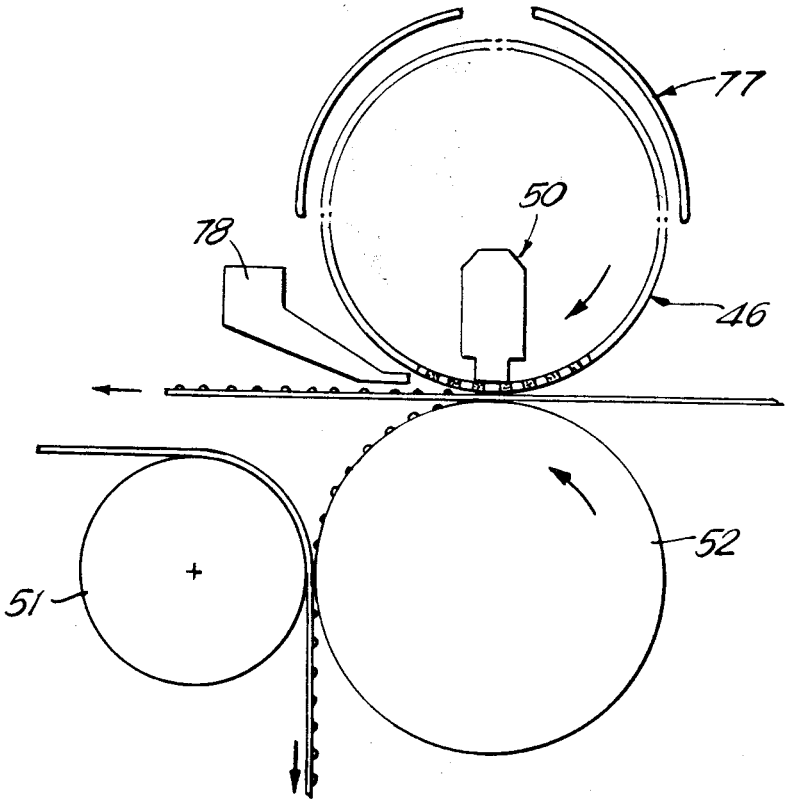
FIG. 9 is a partial, enlarged view of a portion of the apparatus of FIG. 7.
Figure 10:
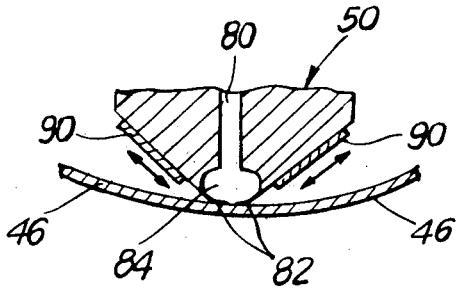
FIG. 10 is a partial, side elevational view, in section, of the adjacent ends of the coating head and perforated cylinder of the apparatus of FIG. 7.

The coating installation shown in block diagram form in FIG. 1 is used for applying a thermoplastic melting substance and comprises a container 1 for receiving, storing and liquifying the substance. Such equipment is known (DAS No. 2,836,545) and will not be described in greater detail here. The coating installation also comprises a line 2 connecting container 1 with a conveying mechanism 3, which conveys the melting substance through the coating installation. The conveying or transporting mechanism 3, e.g. a volume-type pump is mechanical, e.g. is connected by a shaft 4 to a motor drive 5. The coating installation also comprises a coating head 6 with a coating nozzle 8 connected by means of a line 7 and which by means of a line 9 is connected to the conveying mechanism 3. By means of a mechanical connection 11, coating head 6 is connected to a motor drive 10. Part or all the coating head 6 is moved by drive 10, e.g. by laterally displacing head 6 with respect to the substrate movement or by rotating part thereof, of FIGS. 6 and 7. A control 12, whose instructions are supplied by lines 13, 14 to motor drives 5, 10, is associated with the coating installation.

FIG. 2 shows a coating installation in partial block diagram form. The difference between this installation and that of FIG. 1 is merely with regards to the arrangement of motor drive 10, connected by mechanical connections 11, 16 both to coating head 6 and to coating nozzle 8. In this case, as required, coating nozzle 8 can be moved alone or together with coating head 6. In FIGS. 1 and 2, drive 10 is responsible not only for the movement of the complete coating head 6, but also for the movement of all parts required for applying the coating compound, e.g. valves, switches for heating systems and the like. The mechanical drive can naturally be replaced by an equivalent hydraulic, pneumatic or electric drive.

The coating installations according to FIGS. 1 and 2 are suitable not only for the application of thermoplastic coatings, but also for thermosetting plastic coatings, it being optionally necessary to carry out certain modifications on some devices. However, in general, these installations have the advantage that they have a simple construction and do not require ground powder. Instead, they can use granular material, but still obtain uniform coatings.

The installations shown diagrammatically in FIGS. 3 to 5 illustrate the overall arrangement for the continuous application of partial coatings to a textile web or to cut portions transported on a substrate. The same reference numerals designate the same parts as in FIGS. 3 to 5.

The textile substrate 15 is unwound from an unwinding device 16, passes through a preheating zone 17 and reaches a first station 18 (FIG. 3), where one side of the substrate is indirectly coated, i.e. the coating compound is supplied through line 9, e.g. a heated hose, to coating head 6 with coating nozzles 8 and is applied to a roller 19 which, as a function of the desired partial coating, has corresponding surface characteristics and transfers the applied coating to substrate 15. A counter-pressure roller 20, also having different coating characteristics, cooperates with roller 19 for the purpose of calendering the application coating. Behind the first station 18 is arranged a second station 21 with the same construction and is used for providing a second indirect coating application to substrate 15, so that now the complete partial coating is applied. Obviously, the number of stations used is dependent on the nature of the partial coating and it is possible to have one, two or more stations 18 to 21.

Following station 21, the textile substrate 15 passes into a heated continuous passage section 22 for further melting of the thermoplastic materials or for drying or condensing out the coating compound. After passing through the heated section 22, there is a further calendering by a calender 23 with rollers 24, 25 for improving the adhesion of the coating compound to the substrate 15, after which it is wound up onto a winding-on device 26.

The temperature in preheating zone 17 is adjustable in such a way that the textile substrate 15 can be preheated to ensure a completely satisfactory transfer from roller 19 to substrate 15 or, in the case of direct application, from coating nozzle 8 to substrate 15. As a function of the substrate 15 to be processed, calender 23 can also be omitted if calendering in stations 18, 21 ensures a reliable adhesive of the coating to the substrate surface.

The installation according to FIG. 4 is used for the direct application of the coating compound to substrate 15, i.e. the coating compound is applied to substrate 15 in a coating station 27 via line 9, coating head 6 and coating nozzle 8. The coating compound is then further heated in the continuous passage section 22 and then calendered in calender 23. In station 27, a base 28 is arranged below substrate 15 and is either stationary or moves with the said substrate.

FIG. 5 shows a lining or backing installation, i.e. for sticking together textile substrates 15 or 15'. In a lining station 29, the adhesive compound is directly applied to substrate 15. Adhesion to the second substrate 15' then takes place between a roller 30 and a counter-pressure roller 31. Following further heating in the continuous passage section 22, calendering takes place in calender 23. In the lining station 29, roller 30 together with a further roller 32 also serve for the guidance of a belt 33 over the fixed base 28. Belt 33 moves at the same speed as substrate 15.

FIG. 6 shows a coating head 6 having a connecting piece 35 on one outside wall 34 and to which is connected line 9 (not shown). On a further outer wall 36 is provided the coating nozzle 8. Casing 37 of coating head 6 contains a rotary slide valve 38 with depressions 39, through which the coating compound is intermittently supplied to coating nozzle 8, which is supplied through a line 40 to depressions 39 and then through a line 41 to coating nozzle 8. Rotary slide valve 38 permits an accurate dosing of the coating compound leaving nozzle 8. Coating head 6 can coprise one, two or more coating nozzles 8. As a function of the number of nozzles 8, the casing and slide valve 38 has a corresponding length. In FIG. 6, dosing takes place in a regular manner, but it is also possible for dosing to take place at irregular intervals enabling different application effects and/or rigidities to be obtained, which can be further increased by different depressions 39. If, in addition, coating head 16 is pivotably arranged in a plane parallel to the substrate plane, it is possible to vary the spacing between the individual coating nozzles 8 by the sloping arrangement of head 6 with respect to the direction of movement of substrate 15. In this way, it is possible to obtain very closely juxtaposed partial coatings, which would not be possible due to the necessary spacing between two nozzles 8 in the case of a coating head 6 arranged perpendicular to the substrate movement.

Interrupted application to substrate 15 can also be obtained by means of controlled valves. Hydraulic, pneumatic, electric or mechanical energy can be used for operating these valves. There is also a considerable number of valves when using a relatively large number of juxtaposed nozzles 8. In this case, the rotary slide valve 38 can lead to the same action as with a larger number of valves. As thermoplastic and in part thermosetting plastic compounds have a lubricating action, the rotary slide valve 38 leads to the same operational reliability as with individual valves. In addition, the surface of slide valve 8 and the bore of casing 37 can undergo surface treatment, e.g. siliconization, chromium plating, etc. If a plurality of juxtaposed valves 38 are used, they can move at different speeds to achieve different coatings.

Further coating effects can be obtained through the design of coating nozzles 8. By varying the width, size and shape of the nozzle ends, it is also possible to obtain different coating effects. This is particularly advantageous if different stiffening effects are to be obtained on the substrates 15 to be treated.

Heating in preheating zone 17 and in continuous passage section 22 can take place in different ways, e.g. by electric heating, infrared heating and heating by a hot air blower. Substrate 15 must be unrolled and rolled up again as carefully as possible in order to prevent any distortion thereof.

It is admittedly possible to obtain a large number of partial coating patterns with the nozzles 8 arranged in coating head 6, but due to the dimensions of the nozzles difficulties can be encountered in the production of closely juxtaposed coating portions. Admittedly, an improvement can be obtained by the aforementioned pivoting of the coating head 6 about a vertical axis, but in this case an additional adjusting device must be provided not only for coating head 6, but also for the support 28 positioned below the textile substrate 15. These difficulties can be eliminated by the coating installation according to FIGS. 7–10 in which coating is performed on the one hand with a coating head 6, e.g. according to FIG. 4 and on the other with a coating head 50 arranged within a rotating, perforated metal cylinder 46, where the pressurized melting compound is applied from a coating nozzle 49 to the inside of the metal cylinder 46 and from there through the perforations. In the case of both devices, application of the melting compound can take place indirectly via a transfer belt or a transfer roller or directly to the textile substrate 15. FIG. 7 illustrates the indirect application of the melting compound to a carrying belt 45, e.g. a PTFE belt in connection with a coating head 6 provided with not shown nozzles and said belt transfers the compound to substrate 15. In connection with the application with metal cylinder 46, it is possible to use both direct and indirect applications by means of a transfer roller 51 to textile substrates 15. In the case of direct application, there is no need for the carrying belt 45. When using coating head 6, indirect application via belt 45 offers the advantage that by pivoting coating head 6 about a vertical axis the distance between the nozzle ends can be reduced. In this case, the bearing arm 47 arranged on the other side of carrying belt 45 must also be pivotable.

In the case of perforated metal cylinder 46, there is no need for carrying belt 45, because in cylinder 46 the perforations can be arranged as close to one another as required. In the case of the indirect application of the melting compound, a treated transfer roller 51 is provided and serves to transfer the compound to substrate 15. In the case of a direct application of the melting compound, a heated acceptance or take-over roller 52 is used and there is then generally no need for transfer roller 51. If carrying belt 45 is used for the indirect application of the melting compound, the transfer roller 51 is used as a drive roller for belt 45.

Substrate 15 is unwound from a unwinding device 16 and passes via a guide pulley 53 onto a preheating roller 54 and from there to acceptance roller 52, where the melting compound is applied either directly or indirectly. The partially coated substrate 15 passes through a calender having two coolable calender rolls or bowls 55, 56, provided with an adjustable bowl gap, cf arrow 57. After calendering the substrate 15 passes via two cooling rollers 58, 59 and a guide pulley 60 to a winding-on device 61 onto which it is wound by a winding drive 62.

A further substrate 15 is unwound from a further unwinding device 63, guided via a guide pulley 64, a preheating roller 65 and a calender bowl 56 and is lined with the substrate coated with the melted compound. Both coating and lining can take place with the present installation. The different rollers are driven by a motor drive 66, which guides rollers 57, 58, 59 by means of an envelope member 67, e.g. an open-link chain and by gears indicated by the dot-dash line. Envelope member 67 also drives a diagrammatically shown gear 69, which in turn drives rollers 52, 55, 65, optionally by means of intermediate gears. In turn, rollers 52, 55 drive rollers 51 or 57. Carrying belt 55 is driven by transfer roller 51 and is tensioned by a gripping device with a gripping wheel 70. Guide pulleys 71, 72 guide carrying belt 45.

Cylinder 46 can have random perforations, e.g holes, slots, etc in the most varied arrangements, sizes and shapes.

The dosing of the melting compound can take place by pressure in the compound supply, the size of the perforations in cylinder 46, the width of the opening between sealing lips 82 and the substrate drive. The coating head 50 with its cylinder 46 extends over the width of the machine or acceptance roller 52, cf arrow 73, which is also used for adjusting the roller gap of transfer roller 51. Coating head 50 is a beam with a cavity located in its interior comprising a feed-in duct 79, a main duct 80 having a slot or juxtaposed slots and an opening or issuing chamber 81. Chamber 81 is bounded by two sealing lips 82 forming an opening or gap. As feed-in duct 79 and main duct 80 do not extend up to the end faces of the beam, it is merely necessary to laterally seal opening chamber 81. This is effected by two rods 90 attached to the sealing lips and adjustably coupled to coating head 50, which follow the profile or chamber 81 and can also be used for adjusting the width of the opening of chamber 81, either through using varyingly long rods or by making the rods displaceable. The material of the rod is slightly deformable, e.g. in the form of a suitable plastic or a hose, so that on placing the beam on perforated cylinder 46, the sealing lips 82, e.g. of plastic or metal, can adapt closely to the inside of cylinder 46. Ducts 83 also extend over the length of the beam and into these can be inserted heating elements enabling a precise temperature to be respected and set.

Cylinder 46 is rotated by a not shown variable speed drive. The melting compound is supplied under pressure to the internal coating head 50 and is transferred to substrate 15 by the opening formed in front of sealing lips 82 and the perforations in cylinder 46. The melting compound is heated to a flowable state in a storage container and its temperature is regulated by a further heat supply up to an in coating head 50. The temperature can be additionally influenced by infrared radiation sources 77 external to the outer circumference of cylinder 46.

In order to permit a clean breaking off of melting compound on passing out of the perforations of cylinder 46 hot air, whose pressure and temperature can be adjusted, can be blown through the nozzles 78, e.g. in the vicinity of the raising point of cylinder 46 from substrate 15. The plant shown in FIG. 7 can be simplified in that the melting compound is only applied in acoordance with one coating type and the lining device can be omitted.

As a use, reference is made to the production of spun non-woven fabrics from thermoplastic adhesive fibres, which have hitherto been produced from slitted foils, but only accompanied by lining with prepared, e.g. siliconized paper could they be cut to the desired sizes in order to prevent sticking together by the blade temperature produced at the time of cutting. The aforementioned coating modes make it possible to produce spun non-woven fabrics in a simple way. The subsequent separation into strips can be avoided by interrupting the application in the fabric. This obviates the need for expensive intermediate layers. It is possible to pass equally quickly to some other application type, independently of whether continuous or discontinuous coating forms are involved.

The plant according to FIGS. 7–10 is mainly used for adhering textile substrates with a thermoplastic adhesive, but it is also possible to apply other agents, e.g. stiffening agents. The plant can also be used without difficulty for the application of thermosetting plastics.

EXAMPLE

Coating takes place on a textile or non-textile web of e.g. 120 g/m$^2$ of non-woven fabric for clothing inserts using 19 g/m$^2$ of polyamide and a coating head according to FIG. 8 and a perforated cylinder in a 17 mesh arrangement (arrangement of the points on an equilateral triangle with angles of 60°), in order to permit subsequent sticking to the back for reinforcement purposes with upper-material in the clothing industry on the generally known splicing or pasting presses at 150° C., 300 to 3500 g pressure/cm$^2$ and for 12 to 15 seconds.

The following compounds are used as coating materials for the partial coating of textile substrates with thermoplastic adhesives: ethylene-vinyl acetate copolymers, ethylene-ethyl acrylate copolymers, polystyrene-butadiene-polystyrene block polymers, polystyrene-isoprene-polystyrene block polymers, polyethylene, polypropylene, butyl isobutyl and isoprene rubber types, ethylene propylene rubber, polyvinyl acetate and polymers thereof, saturated polyesters and copolyesters, polyurethanes, polyamides and copolyamides.

The thermosetting plastics used, e.g. phenol and cresol resins, as well as epoxy resins, are applied in liquid form and after hardening form brittle, pressure-resistant materials. Prior to cross-linking, up to 60% of fillers can be admixed therewith.

While various embodiments have been chosen to illustrate the invention, it will be understood by those skilled in the art that various changes and modifications can be made therein without departing from the scope of the invention as defined in the appended claims.

I claim:

1. An apparatus for applying partial surface coatings to textile substrates, particularly adhesive compounds, comprising:

a rotatable metal cylinder having inner and outer cylindrical surfaces, having perforations extending therethrough from said inner surface to said outer surface and being rotatable about a longitudinal axis;

a coating head mounted inside of said cylinder and having at least one coating nozzle adjacent and facing said inner surface;

feed means for moving a textile substrate in contact with said outer surface adjacent said coating nozzle;

a hot air nozzle mounted adjacent to and externally of said cylinder and directed at a contact point of said cylinder with the textile substrate; and supply means for conveying a plastic coating compound to said coating head.

2. An apparatus according to claim 1 wherein said feed means comprises a rotating roller adjacent said outer surface of said cylinder and opposite said nozzle, said rotating roller forming a nip with said cylinder for the textile substrate.

3. An apparatus according to claim 2 wherein said feed means comprises a pair of calender rolls receiving the textile substrate downstream of said rotating roller and rotating simultaneously with said rotating roller.

4. An apparatus according to claim 1 wherein said coating head is a beam extending parallel to said axis and comprises a feed duct, a main duct extending from said feed duct and an opening chamber extending from said main duct, said opening chamber being bounded by two sealing lips adapted closely to the inside of the cylinder which are supported by mounting means on said coating head and define an outlet opening therebetween for controlling flow from said opening chamber.

5. An apparatus according to claim 4 wherein said main duct comprises a continuous slot.

6. An apparatus according to claim 4 wherein said main duct comprises juxtaposed ducts.

7. An apparatus according to claim 4 wherein said beam comprises ducts for receiving heating elements.

8. An apparatus according to claim 1 wherein said nozzle is adapted to emit adhesive coating compound under pressure.

9. An apparatus according to claim 1 wherein said main duct comprises a continuous slot.

10. An apparatus for applying partial surface coatings to textile substrates, particularly adhesive compounds, comprising:

a rotatable metal cylinder having inner and outer cylindrical surfaces, having perforations extending therethrough from said inner surface to said outer surface and being rotatable about a longitudinal axis;

a coating head mounted inside of said cylinder and having at least one coating nozzle adjacent and facing said inner surface, said coating head being a beam extending parallel to said axis and including a feed duct, a main duct extending from said feed duct and an opening chamber extending from the main duct, said opening chamber being bounded by two sealing lips adapted closely to the inside of the cylinder and supported by mounting means on said coating head and defining an outlet opening therebetween for controlling flow from said opening chamber, said mounting means having rods attached to said sealing lips and adjustably coupled to said coating head whereby said opening can be adjusted in width by adjusting positions of said rods;

feed means for moving a textile substrate in contact with said outer surface adjacent said coating nozzle; and supply means for conveying a plastic coating compound to said coating head.

11. An apparatus according to claim 10 wherein heating means are adjacent said cylinder.

12. An apparatus according to claim 11 wherein said heating means is mounted within said cylinder for heating the coating compound.

13. An apparatus according to claim 11 wherein said heating means is mounted externally of said outer surface of said cylinder.

14. An apparatus according to claim 10 wherein said nozzle is adapted to emit adhesive coating compound under pressure.

15. An apparatus according to claim 10 wherein said main duct comprises juxtaposed ducts.

16. An apparatus according to claim 10 wherein said feed means comprises a rotating roller adjacent said outer surface of said cylinder and opposite said nozzle, said rotating roller forming a nip with said cylinder for the textile substrate.

17. An apparatus according to claim 1 wherein said feed means comprises a pair of calendar rolls receiving the textile substrate downstream of said rotating roller and rotating simultaneously with said rotating roller.

* * * * *